US009858785B2

(12) United States Patent
Peeters et al.

(10) Patent No.: US 9,858,785 B2
(45) **Date of Patent: *Jan. 2, 2018**

(54) BATTERY-POWERED DEVICE HAVING A BATTERY AND LOUD SOUND DETECTOR USING PASSIVE SENSING

(71) Applicant: Roost, Inc., Sunnyvale, CA (US)

(72) Inventors: Roel Peeters, San Carlos, CA (US); James Blackwell, Los Gatos, CA (US)

(73) Assignee: ROOST, INC., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/728,727

(22) Filed: Jun. 2, 2015

(65) Prior Publication Data

US 2016/0093188 A1 Mar. 31, 2016

Related U.S. Application Data

(63) Continuation of application No. 14/554,989, filed on Nov. 26, 2014, now Pat. No. 9,070,263, which is a continuation of application No. 14/501,011, filed on Sep. 29, 2014.

(51) Int. Cl.

| | |
|---|---|
| ***G08B 25/08*** | (2006.01) |
| ***G08B 17/10*** | (2006.01) |
| ***G08B 1/08*** | (2006.01) |
| ***G08B 29/18*** | (2006.01) |
| ***G08B 25/10*** | (2006.01) |
| *G08B 17/113* | (2006.01) |

(52) U.S. Cl.

CPC ..... *G08B 17/10* (2013.01); *G08B 1/08* (2013.01); *G08B 25/10* (2013.01); *G08B 29/181* (2013.01); *G08B 17/113* (2013.01)

(58) Field of Classification Search

CPC ..... G08B 17/10; G08B 25/00; G06F 1/26

USPC ..... 340/692, 506, 539.1, 628, 632, 531

See application file for complete search history.

(56) References Cited

U.S. PATENT DOCUMENTS 5,895,728 A 4/1999 Walker et al.
6,150,943 A * 11/2000 Lehman ..... G08B 7/062 340/332

(Continued)

FOREIGN PATENT DOCUMENTS

EP 0780915 A1 6/1997

OTHER PUBLICATIONS

Peeters et al., U.S. Appl. No. 14/501,011 entitled "Battery-Powered Device Having a Battery and Loud Sound Detector Using Passive Sensing," filed Sep. 29, 2014, 8 pages.

(Continued)

*Primary Examiner* — Phung Nguyen

(74) *Attorney, Agent, or Firm* — Davis Wright Tremaine LLP; Philip H. Albert

(57) ABSTRACT

A communication device comprises a processing circuit having at least two modes, a sleep mode and an awake mode, a wireless communications circuit that can wirelessly send a message as to whether an alarm has been triggered, and a passive sensor, powered by audio signals impinging on the passive sensor, that provides at least an approximation of an audio signal to the processing circuit so as to cause the processing circuit to switch between the at least two modes. The communication device can be housed in a housing sized to fit into a battery compartment.

13 Claims, 3 Drawing Sheets

(56) References Cited

U.S. PATENT DOCUMENTS

| | | | | |
|---|---|---|---|---|
| 7,015,807 | B2 * | 3/2006 | Roby | G08B 1/08 340/511 |
| 8,558,708 | B2 * | 10/2013 | Albert | G08B 3/10 181/151 |
| 9,070,263 | B1 | 6/2015 | Peeters et al. | |
| 2003/0122523 | A1 | 7/2003 | Kim et al. | |
| 2004/0108856 | A1 | 6/2004 | Johnson | |
| 2006/0082455 | A1 | 4/2006 | Andres et al. | |
| 2007/0146127 | A1 * | 6/2007 | Stilp | G08B 1/08 340/531 |
| 2007/0200720 | A1 | 8/2007 | Dreiskemper et al. | |
| 2008/0157956 | A1 | 7/2008 | Radivojevic et al. | |
| 2009/0279392 | A1 | 11/2009 | Scott et al. | |
| 2009/0284389 | A1 | 11/2009 | Klassen et al. | |
| 2010/0052613 | A1 | 3/2010 | Leung et al. | |
| 2010/0057406 | A1 | 3/2010 | Smout | |
| 2010/0085840 | A1 | 4/2010 | Lazaridis et al. | |
| 2010/0085841 | A1 | 4/2010 | Lazaridis et al. | |
| 2010/0085842 | A1 | 4/2010 | Lazaridis et al. | |
| 2010/0102971 | A1 | 4/2010 | Virtanen et al. | |
| 2010/0230606 | A1 | 9/2010 | Liu et al. | |
| 2010/0279745 | A1 | 11/2010 | Westcott et al. | |
| 2011/0193713 | A1 | 8/2011 | Albert et al. | |
| 2011/0300433 | A1 | 12/2011 | Kim | |
| 2012/0114983 | A1 | 5/2012 | Stokes et al. | |
| 2013/0002421 | A1 | 1/2013 | Lazaridis et al. | |
| 2013/0135097 | A1 | 5/2013 | Doezema | |
| 2013/0214730 | A1 | 8/2013 | Lu et al. | |
| 2013/0225127 | A1 | 8/2013 | Cavacuiti et al. | |
| 2013/0325190 | A1 | 12/2013 | Imes et al. | |
| 2014/0112226 | A1 | 4/2014 | Jafarian et al. | |
| 2015/0018643 | A1 | 1/2015 | Cole et al. | |
| 2015/0032412 | A1 | 1/2015 | Chizhevskiy et al. | |
| 2015/0173674 | A1 | 6/2015 | Hayes et al. | |

OTHER PUBLICATIONS

International Search Report and Written Opinion in International Patent Application No. PCT/US2015/039312, dated Jan. 15, 2016, 12 pages.

* cited by examiner

BATTERY-POWERED DEVICE HAVING A BATTERY AND LOUD SOUND DETECTOR USING PASSIVE SENSING

CROSS-REFERENCES TO RELATED APPLICATIONS

This application, entitled "BATTERY-POWERED DEVICE HAVING A BATTERY AND LOUD SOUND DETECTOR USING PASSIVE SENSING," is a continuation of U.S. patent application Ser. No. 14/554,989, filed on Nov. 26, 2014 (U.S. Pat. No. 9,070,263), which is a continuation-in-part of U.S. application Ser. No. 14/501,011, filed on Sep. 29, 2014, the content of which is incorporated by reference herein in its entirety.

FIELD

The present disclosure relates generally to adding communications capability and sensing capability into battery-powered devices not having a native communications capability, more specifically, for sensing and reporting status.

BACKGROUND

Many devices that did not traditionally have communications capabilities are being replaced by updated devices that do have native communications capabilities. For example, newer, more expensive smoke detectors have native communications capabilities. However, this does not help with other smoke detectors and it is typically more cost effective to reuse the existing smoke detector and add in communications capabilities.

In adding such functionality, cost of components and assembly are a consideration. Another consideration is power consumption, as in a normal lifetime of smoke detector battery, only a very small portion of that lifetime is spent in an alarm activated state.

SUMMARY

A communication device comprises a processing circuit having at least two modes, a sleep mode and an awake mode, a wireless communications circuit that can wirelessly send a message as to whether an alarm has been triggered, and a passive sensor, powered by audio signals impinging on the passive sensor, that provides at least an approximation of an audio signal to the processing circuit so as to cause the processing circuit to switch between the at least two modes. The communication device can be housed in a housing sized to fit into a battery compartment.

The following detailed description together with the accompanying drawings will provide a better understanding of the nature and advantages of the present invention.

DETAILED DESCRIPTION

For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In embodiments of devices explained herein, sensing of an alarm activated state is done using a passive device thereby eliminating or reducing the amount of energy consumed for sensing while the activated state is not present. One approach to sensing an audio input is to use a microphone, such as a small electric microphone, listen for inputs—often by running a microprocessor that executes instructions including instructions to process inputs received from the microphone to determine if an appropriate audio input is occurring. This, however, can waste power.

Figure 1:
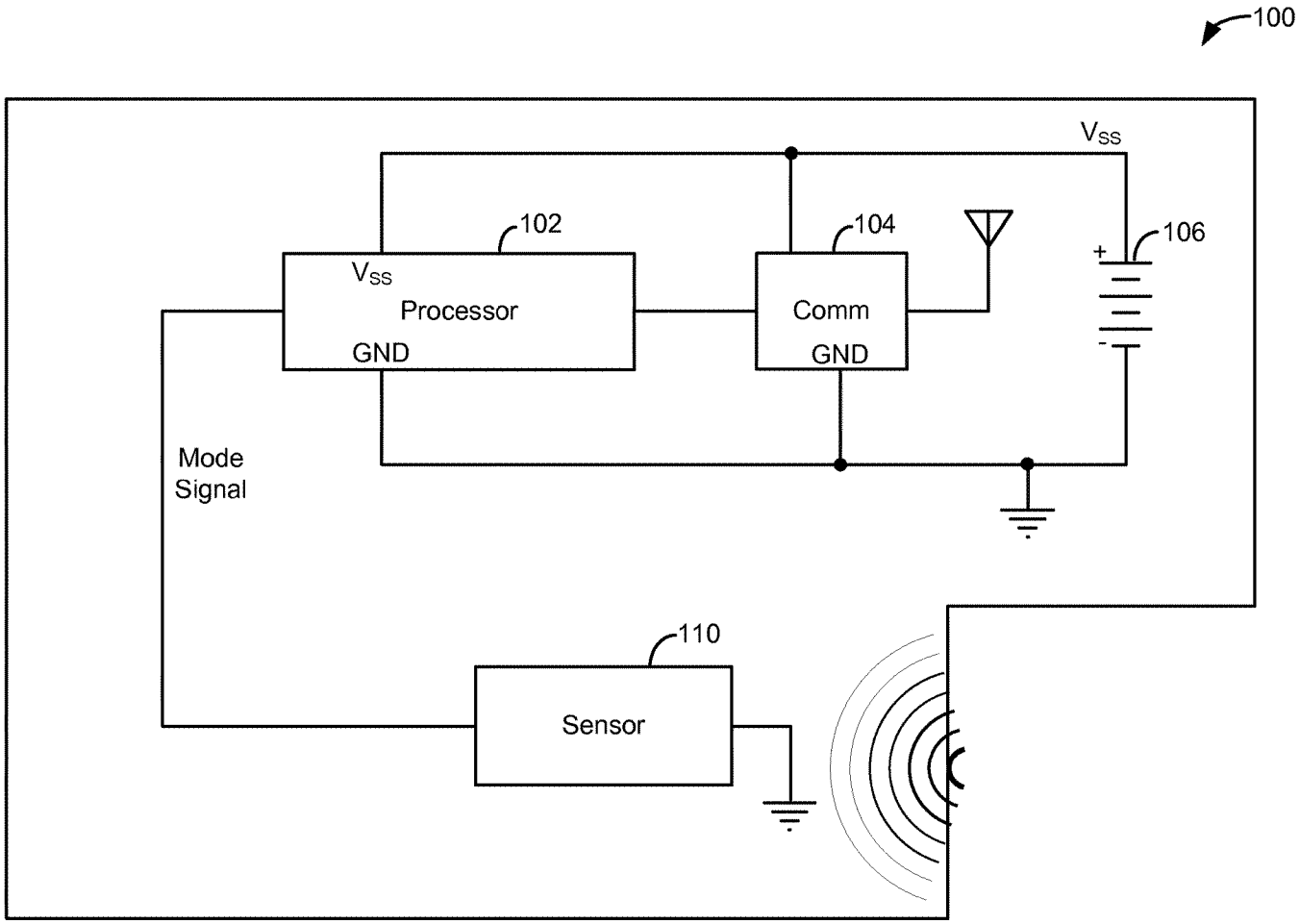
FIG. 1 illustrates a novel battery-based device with integrated audio sensing using a passive sensor.

FIG. 1 is a schematic diagram showing various components as might be used. As shown there, a device 100 includes a processor 102, a communications module 104 (which might comprise an antenna and/or some control logic and analog circuit elements), a battery 106 for powering processor 102 and communications module 104. In other variations, processor 102 is replaced with a simpler control circuit. Processor 102 can be a microprocessor or microcontroller or system on a chip, as appropriate.

Battery 106 might be integrated into a housing such that all of device 100 would fit into a chamber sized to accept a conventional battery. Preferably, processor 102 has a sleep mode and an awake mode, wherein power consumption is reduced in the sleep mode relative to the awake mode. Processor 102 switches from the sleep mode to the awake mode in response to a signal received at a mode signal input to processor 102. A passive sensor 110 is coupled to the mode signal input of processor 102. Passive sensor 110 can be a sound sensor.

Passive sensor 110 might comprise a piezoelectric transducer, such as those used as electrically powered output devices that generate audio. Given the location of device 100 (inside or near a smoke detector or other alarm signaling device), the typical minimum sound level requirement for such detector/devices, and the form of the signal, the sound energy impinging on passive sensor 110 in an alarm condition is sufficient energy to generate the mode signal without needing any other electrical power.

By taking advantage of the piezoelectric property that the transducer can generate a voltage when excited by an audio signal, and the minimum sound levels expected at passive sensor 110, as well as the level of detail needed from the signal, device 100 can remain in its deepest sleep state, without the need to periodically wake-up to monitor the audio.

In a specific embodiment, a smoke detector has an alarm sound generator, such as a speaker that can generate an 85 dB alarm sound. Given the proximity of device 100 to the speaker, passive sensor 110 can generate enough excitation energy on its own to provide the mode signal, a voltage waveform that wakes processor 102. Once awake, processor 102 can monitor both the frequency and waveform period to determine if the cause of the wake-up was a real alarm. For example, processor 102 might maintain a set of lookup parameters that are compared to a continuing signal received at its mode signal input.

For ease of implementation, passive sensor 110 might be an audio transducer selected to have a resonant frequency close to, or at, the generated frequency of the alarm to increase the amplitude of the resulting output voltage waveform.

For many smoke detectors, the frequency and waveform of its audible alert is standard, such as those defined by ANSI specification ANSI/ASA S3.41-1990 (R2008) (Audible Emergency Evacuation Signal). ANSI specification ANSI/ASA S3.41-1990 (R2008) requires a specific pattern—referred to as "Temporal Three's". This pre-defined pattern can be used to validate that the alarm is being generated by the smoke alarm.

To minimize false triggers, the period and the frequency of the alarm can be learned during an installation process. As part of the installation, the user might be requested to press an alarm "test" button. This would trigger the smoke alarm and processor 102 can use passive sensor 110 to learn both the frequency and pattern of the alarm. Later, this can be used as a base comparison to compare against any future alarms. Thus, if there were a match, processor 102 would send an alarm signal to communication module 104, which could then wirelessly transmit a corresponding message signaling the alarm.

Figure 2:
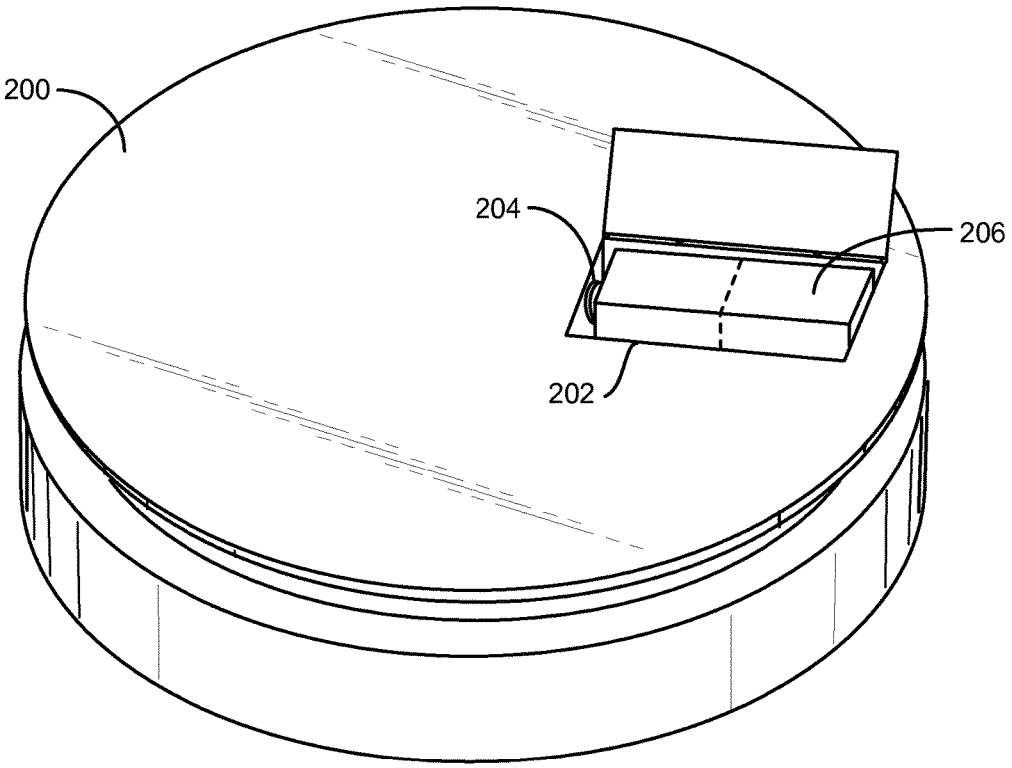
FIG. 2 is a rear view of a smoke detector that might use the battery-based device of FIG. 1.

FIG. 2 illustrates how the circuits described above might be used within a conventional smoke detector housing. As illustrated there, smoke detector 200 has a battery compartment that might otherwise house a conventional 9V battery. In its place, is a housing containing a battery and the circuitry shown in FIG. 1. It might be that this housing has the circuitry in a battery portion 202, terminals 204 for providing electrical power to smoke detector 200, and a battery portion 206 for providing power.

Figure 3:
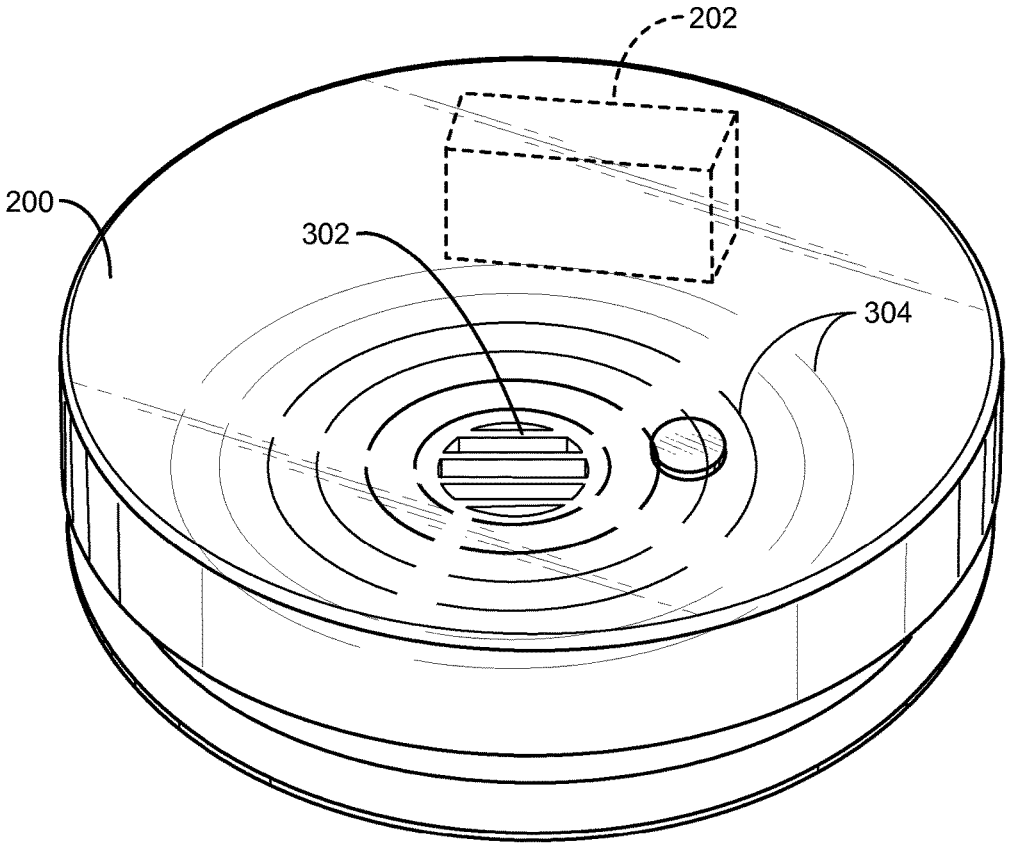
FIG. 3 is a front view of a smoke detector that might use the battery-based device of FIG. 1.

FIG. 3 illustrates how battery portion 202 (or all of the housing containing that portion) can be situated near enough to an alarm emitter 302 so that sound waves 304 are sufficient to power passive sensor 110 (shown in FIG. 1).

The device might also be used in other applications, such as a carbon monoxide detector or other alarm condition signaling system. The device might be used with various battery form factors, such as 9V, AA, AAA, ½ AA, N, or other form factors.

Using the above concepts, users of devices and sellers of such devices or sellers of combined battery/communications elements might have the systems set up so that alarm conditions can be detected without significant quiescent power drain.

The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Further embodiments can be envisioned to one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, while the invention has been described with respect to exemplary embodiments, one skilled in the art will recognize that numerous modifications are possible.

For example, the processes described herein may be implemented using hardware components, software components, and/or any combination thereof. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims.

All references, including publications, patent applications, and patents, cited herein are hereby incorporated by reference to the same extent as if each reference were individually and specifically indicated to be incorporated by reference and were set forth in its entirety herein.

What is claimed is:

1. A device contained in a housing sized to fit into a battery compartment, the device comprising:

a processing circuit having at least two modes including at least a sleep mode and an awake mode; and a passive sensor, powered by audio signals impinging on the passive sensor, that provides a mode signal to the processing circuit so as to cause the processing circuit to switch from the sleep mode to the awake mode, the passive sensor being in proximity to an alarm sound generator when contained in the battery compartment, the proximity being such that power sufficient to generate the mode signal from the passive sensor is provided by sound waves produced by the alarm sound generator.

2. The device of claim 1, wherein the housing is sized to fit into a 9 volt battery compartment.

3. The device of claim 1, wherein the battery compartment is a battery compartment of a smoke detector.

4. A method of sensing and communicating an alarm condition, the method comprising:

having a sound sensor placed in proximity to an alarm sound generator by placing the sound sensor within the battery compartment of an alarm device having the alarm sound generator, wherein the proximity is such that power needed to trigger a mode signal from the sound sensor is provided by sound waves produced by the alarm sound generator;

triggering a processing circuit to switch from a sleep mode to an awake mode in response to the mode signal from the sound sensor; and initiating a wireless communication to send a message as to whether an alarm has been triggered, when the mode signal from the sound sensor is triggered.

5. The method of claim 4, further comprising enclosing the sound sensor, the processing circuit, a wireless communication circuit, and a battery into a housing sized to fit into a battery compartment of the alarm device having the alarm sound generator.

6. The method of claim 5, wherein the alarm sound generator is part of a smoke detector, and wherein the smoke detector is powered by the battery in the housing.

7. A device comprising:

a housing adapted to fit within a battery compartment of an alarm device;

a processing circuit having at least two modes, the two modes including at least a sleep mode and an awake mode; and a passive sensor contained within the housing, powered by audio signals from an alarm sound generator impinging on the passive sensor, adapted to provide a mode signal to the processing circuit so as to cause the processing circuit to switch from the sleep mode to the awake mode, wherein the alarm sound generator is contained in the alarm device, the battery compartment of the alarm device within proximity of the alarm generator to allow the audio signals impinging on the passive sensor to provide sufficient power to provide the mode signal.

8. The device of claim 7, wherein the housing contains the processing circuit.

9. The device of claim 7, further comprising:

a communications module electronically coupled to the processing circuit and adapted to wirelessly transmit electronic signals.

10. The device of claim 9, wherein the housing at least partially contains the communications module.

11. The device of claim 9, wherein the processing circuit is adapted to cause the communications module to transmit a message indicating an alarm condition.

12. The device of claim 11, wherein the processing circuit is adapted to cause the communications module to transmit the message in response to a determination that the audio signals impinging on the passive sensor correspond to an authentic alarm condition.

13. The device of claim 7, wherein the mode signal is provided to the processing circuit without supplemental electrical power.

* * * * *